US006666977B2

(12) United States Patent
Seidl

(10) Patent No.: US 6,666,977 B2
(45) Date of Patent: Dec. 23, 2003

(54) REMOVABLE BAR FOR BAR SCREEN

(75) Inventor: Gerald Seidl, Houston, TX (US)

(73) Assignee: Headworks, Inc., Houston, TX (US)

( * ) Notice: Subject to any disclaimer, the term of this patent is extended or adjusted under 35 U.S.C. 154(b) by 0 days.

(21) Appl. No.: 10/256,418

(22) Filed: Sep. 27, 2002

(65) Prior Publication Data

US 2003/0132149 A1 Jul. 17, 2003

Related U.S. Application Data

(60) Provisional application No. 60/347,690, filed on Jan. 11, 2002.

(51) Int. Cl.[7] ..... B01D 24/46

(52) U.S. Cl. ..... 210/791; 210/159; 210/162; 210/232; 210/499

(58) Field of Search ..... 210/154, 159, 210/162, 170, 232, 413, 499, 791

(56) References Cited

U.S. PATENT DOCUMENTS

| | | | | | |
|---|---|---|---|---|---|
| 1,794,504 | A | * | 3/1931 | Van Norman | 210/159 |
| 3,716,144 | A | * | 2/1973 | Bartlow | 210/499 |
| 4,229,301 | A | * | 10/1980 | Roberts | 210/159 |
| 5,047,148 | A | * | 9/1991 | Arai | 210/499 |
| 5,565,093 | A | | 10/1996 | Frankenberger | 210/158 |
| 5,730,862 | A | | 3/1998 | Mahr | 210/159 |
| 5,922,195 | A | * | 7/1999 | Pastore | 210/162 |
| 6,177,020 | B1 | * | 1/2001 | Wiesemann | 210/791 |

FOREIGN PATENT DOCUMENTS

| | | |
|---|---|---|
| GB | 1373342 | 11/1974 |
| GB | 1525871 | 9/1978 |
| GB | 1598103 | 9/1981 |
| GB | 1598130 | 9/1981 |
| GB | 2170422 | 8/1986 |
| GB | 2275622 | 9/1994 |
| GB | 2350070 | 11/2000 |
| WO | 95/32044 | 11/1995 |

* cited by examiner

*Primary Examiner*—Christopher Upton
(74) *Attorney, Agent, or Firm*—Bracewell & Patterson, LLP

(57) ABSTRACT

A screen system used in fluid channels has individually removable bars in a bar screenfield. The removable bars are connected to the screen system through at least two screenfield bar holders. The screenfield bar holders contain a plurality of slots in which the removable bars insert within. A removably mounted screenfield bar retainer at each screenfield bar holder attaches the removable bars. The retainers have teeth that wedge the bars between them.

19 Claims, 5 Drawing Sheets

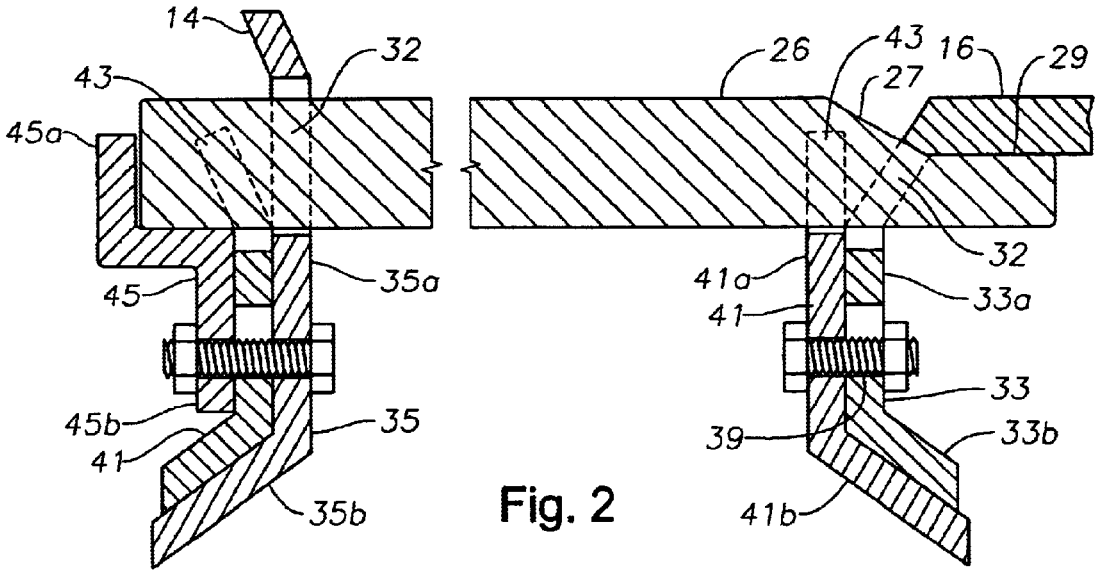
Fig. 2
Fig. 3
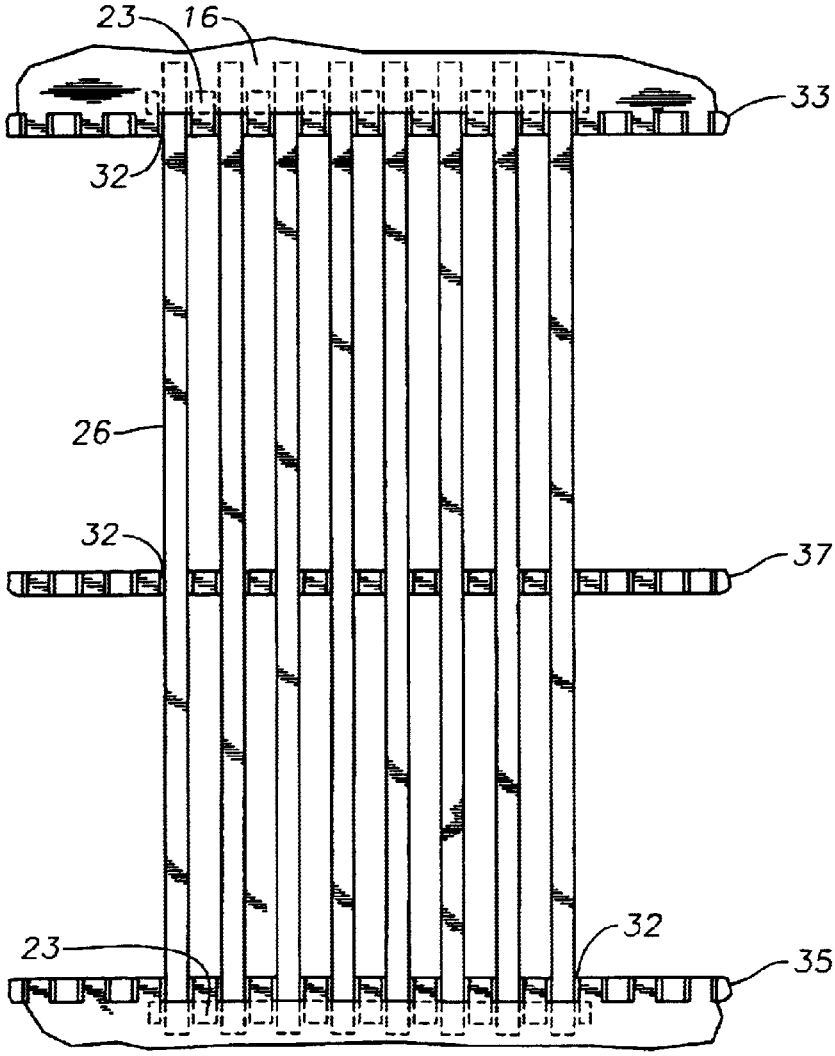

REMOVABLE BAR FOR BAR SCREEN

RELATED APPLICATIONS

This application claims the benefit of a provisional application having U.S. Serial No. 60/347,690, filed on Jan. 11, 2002, which hereby is incorporated by reference in its entirety.

BACKGROUND OF THE INVENTION

1. Technical Field of the Invention

The present invention relates to rake-type cleaning screens located in water conduits such as sewers, wastewater treatment streams, water treatment plants, power plants, and cooling water streams. More particularly, this invention relates to an improved bar screen for use with a rake type screen system.

2. Background of the Prior Art

Bar screens are used for screening solids and debris from flowing liquid streams. An example of such a bar screen system can be found in U.S. Pat. No. 5,730,862 issued to Mahr. In such systems, a series of rakes pass over parallel screen bars, which make up a bar screenfield and remove the debris collected from the flowing stream. Occasionally, large pieces of debris can damage the bar screenfield by either bending or breaking one or more bars within the bar screenfield. When this occurs, the screen system must be repaired by typically cutting out the affected bars and welding new bars in their place. These repair methods are time consuming, potentially hazardous, and expensive. The screen system is typically taken out of service for a relatively long period of time in order to make these repairs, which also adds significantly to the costs of the repairs.

A need exists for a screen system with bars that can be repaired quickly, safely, and cost effectively. Ideally, such a system should be capable of being adapted to the specific fluid applications and also be able to be used on existing screen system equipment with minimal modification.

SUMMARY OF THE INVENTION

The present invention advantageously provides a screen system for removing debris from a flow channel. The screen system includes a screen frame having a bar screenfield that is located below a debris plate. The bar screenfield includes a plurality of individually removable bars. Rakes with a plurality of fingers fit between the bars of the bar screenfield. The rakes are movable along the bar screenfield to clear the bar screenfield of debris.

The bars may be releasably secured in different ways to the frame of the screenfield. Preferably opposite ends of the bars fit within slots of a bar holder. After placement in the slots, a retainer with a plurality of teeth is secured to the holder. The gaps between the teeth are wedge-shaped for wedging the bars in place on the bar holder. The retainer is fastened to the bar holder with a releasable fastener.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof that is illustrated in the appended drawings, which form a part of this specification. It is to be noted, however, that the drawings illustrate only a preferred embodiment of the invention and are therefore not to be considered limiting of the invention's scope as they may admit to other equally effective embodiments.

FIG. 2 is a cross-sectional view of a removable bar installed in the bar screenfield of FIG. 1, taken along the line 2—2 of FIG. 1.

FIG. 3 is a partial top view of the removable bar screenfield of FIG. 1.

DETAILED DESCRIPTION OF THE DRAWINGS

Figure 1:
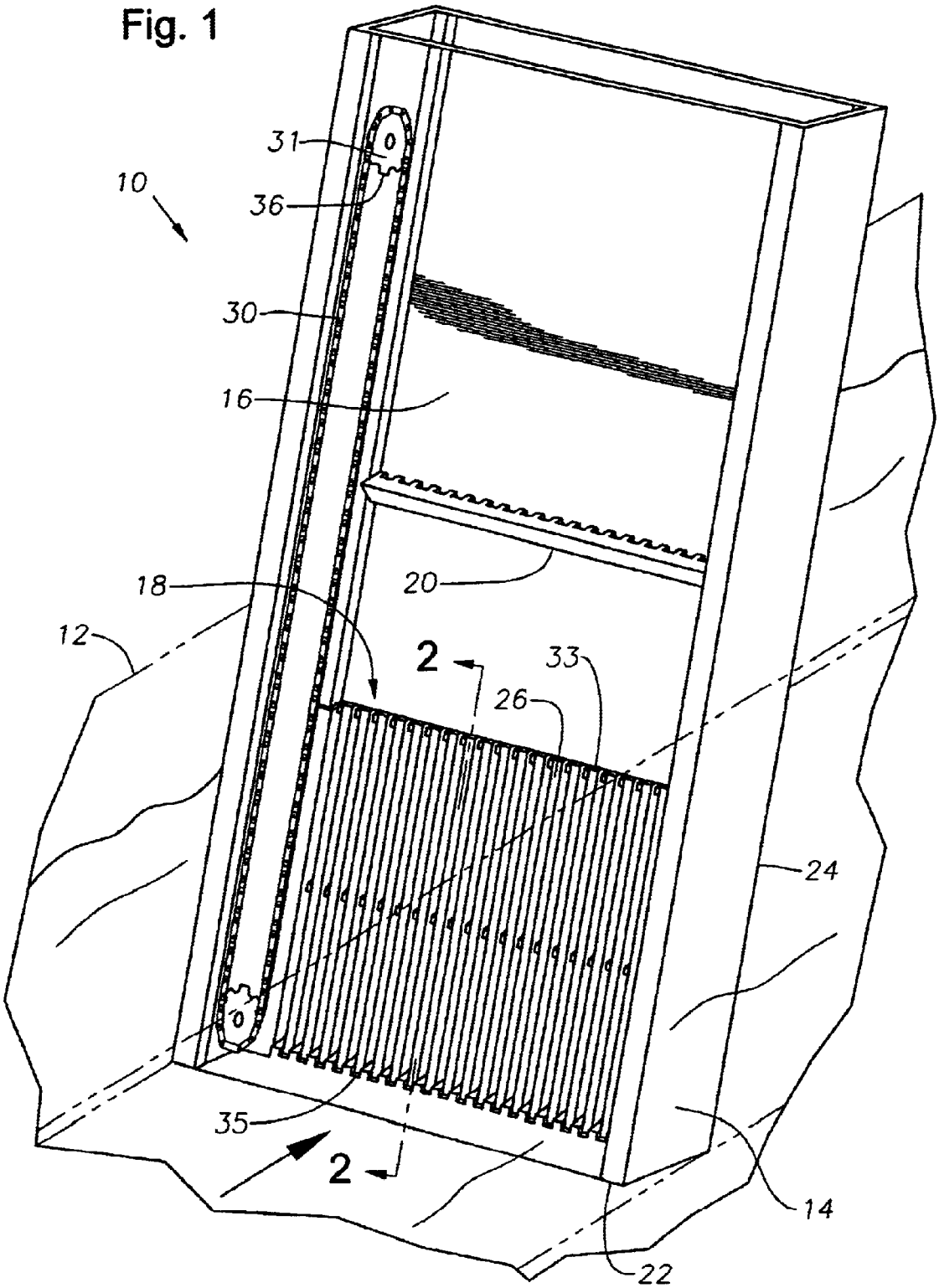
FIG. 1 is a perspective view of a screen system disposed in a liquid flow stream with a singly removable bar screenfield, constructed in accordance with this invention.

FIG. 1 illustrates one type of screen system 10 installed in a channel 12 through which a liquid flow stream passes in the direction indicated by the arrow. This, screen system 10 generally comprises a screen frame 14, a debris plate 16 for preventing debris from spilling over screen system 10, a bar screenfield 18 for collecting solid waste in the flow stream, and a series of rakes 20 (only one shown) for removing solids and debris from bar screenfield 18.

Screen frame 14 has a leading or forward edge 22 and a trailing or rearward edge 24. When screen system 10 is installed in a channel 12, screen frame leading edge 22 will be on the upstream side and screen frame trailing edge 24 will be on the downstream side. The distance between screen frame leading edge 22 and screen frame trailing edge 24 defines the depth dimension of screen frame 14. Bar screenfield 18 and debris plate 16 are attached to screen frame trailing edge 24, with bar screenfield 18 located immediately below debris plate 16.

Bar screenfield 18 comprises a set of parallel, evenly-spaced, vertical bars 26. The preferred embodiment of the invention uses flat bars that are trapezoidal in cross-section. The leading edge of each bar in the preferred embodiment is wider than the trailing edge. The bars are spaced to allow liquid to pass unimpeded, but to block the passage of debris or solids in the flow stream. Bar screenfield 18 contains enough bars 26 to extend across the entire width of screen frame 14. The solids and debris accumulate on the front of bar screenfield 18.

In the preferred embodiment of screen system 10, each rake 20 has a series of tines or fingers 28 to fit in the gaps between each bar 26. Rakes 20 are attached at each end to endless chains 30 that are driven by sprockets 31. The two chains 30 carry rakes 20 in an upward direction over the forward surface of bar screenfield 18. As each rake 20 travels upward along bar screenfield 18, fingers 28 clean the accumulated solids and debris from bar screenfield 18. The solids and debris are carried to the top of screen system 10 for disposal.

Figure 4:
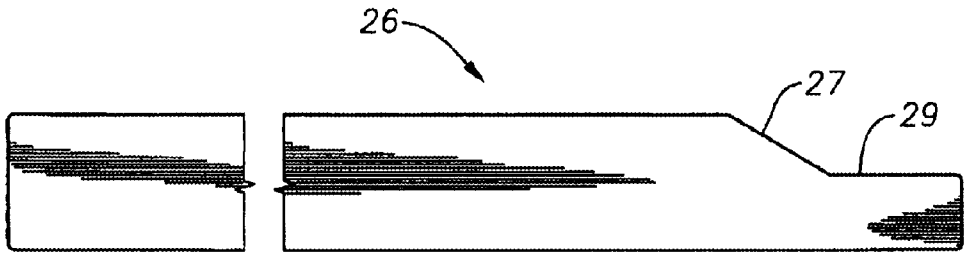
FIG. 4 is a side view of a removable bar of FIG. 1.

Bars 26 are individually removable from the bar screenfield 18. The bars of prior art screen systems are welded in the bar screenfield, thus not individually removable. Bars 26 are long thin metal bars. Referring to FIG. 4, the edge on one end of each bar 26 has a taper 27 extending rearward from the leading edge toward the trailing edge. Taper 27 joins a reduced thickness section 29 in the bar 26, that has parallel leading and trailing sides.

Bars 26 are attached to bar screenfield 18 individually by inserting bars 26 into a series of holder slots 32 (FIG. 3) that are located in two or more screenfield bar holders. FIG. 3 illustrates a multi-screenfield bar holder configuration with an upper screenfield bar holder 33, a lower screenfield bar holder 35, and an intermediate screenfield bar holder 37. The upper screenfield bar holder 33, as shown in FIG. 1, is located at the bottom edge of the debris plate 16. The intermediate screenfield bar holder 37, as illustrated in FIG. 3, is located midway down the bar screenfield 18. The lower screenfield bar holder 35 is located at the bottom of the screen frame 14. Additional intermediate screenfield bar holders 37 can be installed between the upper and lower screenfield bar holders 33, 35, in addition to the midway one illustrated in FIG. 3. Holders 33, 35, 37 may be separate members that are joined, such as by welding, to frame 14. Alternately, upper holder 33 may be formed by bending a lower section of debris plate 16 rearward and forming slots 32 in the holder 33. Similarly, lower holder 35 may be formed by bending a portion of frame 14 downward and forming slots 32 therein. Slots 32 in the upper and lower holders 33, 35 in this instance are thus closed perimeter apertures. Slots 32, however, in intermediate holder 37, however, have open upper ends as shown in FIG. 6.

Figure 6:
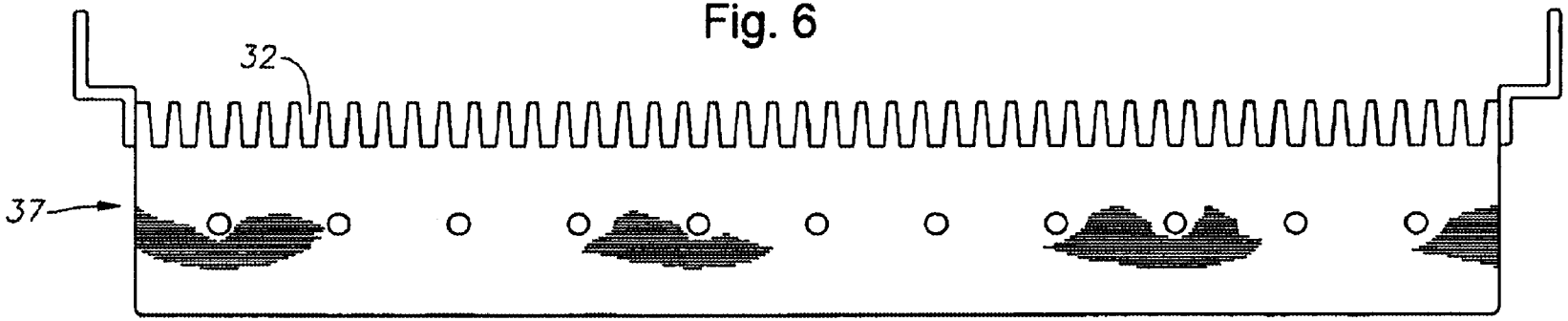
FIG. 6 is a front view of the intermediate screenfield bar holder of FIG. 1.

In each holder 33, 35, 37, the holder slots 32 extend over the entire width of the screen frame 14, as depicted in FIG. 6. Slots 32 may be tapered in width slightly, having a wider forward side than rearward side, to mate closely with the trapezoidal bars 26. Alternately, rectangular slots 32 are also feasible. As shown in FIG. 2, upper bar holder 33 has a forward portion 33*a* and a rearward portion 33*b*. Forward portion 33*a*, which contains slots 32, is in a plane perpendicular to a plane containing bars 26. Rearward portion 33*b* is inclined at an obtuse angle relative to forward portion 33*a*. Similarly, lower bar holder 35 has a forward portion 35*a* that is parallel to forward portion 33*a* and a rearward portion 35*b* that is inclined relative to forward portion 35*a*. Intermediate holder 37 is not shown in FIG. 2, and in this embodiment, lies in a single plane. If desired, intermediate holder 37 could have a similar configuration to the other holders 33, 35.

The reduced thickness section 29 on the upper end of each bar 26 is inserted in slots 32, which are located at the bottom edge of the debris plate 16. A portion of reduced thickness section 29 slides rearward of debris plate 16, as shown in FIG. 2. The width of each slot 32 is slightly larger than the width of each bar 26 so that bar 26 inserts freely into slots 32. Tapered edge 27 prevents bars 26 from being wedged too far up the debris plate 16.

Figure 5:
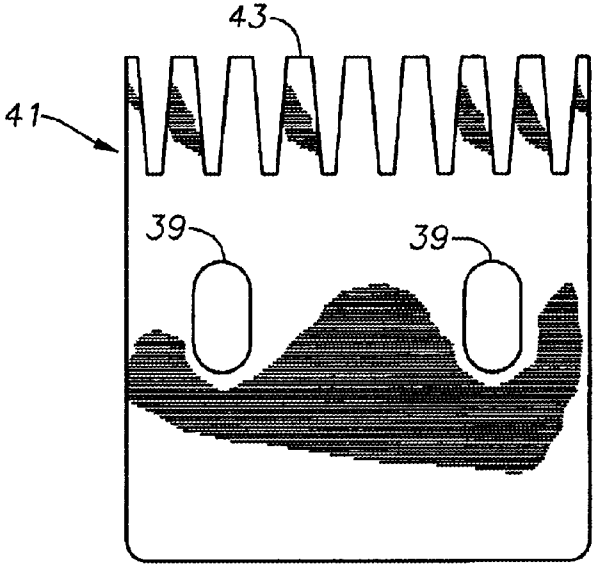
FIG. 5 is a front view of a screenfield bar retainer for use in the bar screen of FIG. 1.

A series of holes 39 exist rearward from slots 32. Holes 39 are used to attach screenfield bar retainers 41 to each of the locations where slots 32 reside. Screenfield bar retainers 41 are thin rectangular metal plates with tines or teeth 43 on the forward edge of the screenfield bar retainer 41, as shown in FIG. 5. The gap between each tine 43 is tapered and slightly smaller at the narrow portion than each bar 26. Tines 43 are wedged between bars 26 after bars 26 are inserted in holder slots 32 as depicted in FIG. 2. Screenfield bar retainers 41 thus stabilize and reinforce bars 26. Bar retainers 41 are located on both the upper holder 33 as well as the lower holder 35. Optionally, bar retainers 41 could be utilized for the intermediate holder 37 if bars 26 are sufficiently long to require additional stabilization.

Screenfield bar retainers 41 contain at least two attachment holes for attaching the screenfield bar retainers 41 to the holder holes 39 by fasteners or bolts. As shown in FIGS. 2 and 5, the plane containing retainer teeth 43 is at an obtuse angle relative to a central portion 41*a*. Also retainer 41 has a rearward portion 41*b* that is at an obtuse angle relative to central portion 41*b*. The angle of rearward portion 41*b* matches that of holder rearward portion 33*b*. Screenfield bar retainers 41 are bolted to holes 39 located rearward of holder slots 32, as shown in FIG. 2, by aligning the screenfield bar retainer holes and holes 39 and inserting a bolt through them. As the bolt is tightened, the taper of lower portions 33*b* draws retainer 41 central portion 41*a* into abutting engagement with holder forward portion 33*a*. This movement causes retainer teeth 43 to wedge bars 26 between them. The angle of the inclined plane containing teeth 43 provides compliance for slightly different dimensions of bars 26. Screenfield bar retainers 41 are installed one after another for the entire width of the screen frame 14.

Each side end tine 43 of each screenfield bar retainers 41 is only about one-half of the width of the remaining tines 43. The side end tine 43 shape allows the screenfield bar retainers 41 to be placed in side-by-side abutment and still have the end tine 43 align with the holder slots 32. Having the screenfield bar retainers 41 so narrow in comparison to the width of the screen frame 14 allows for more versatility since individual screenfield bar retainers 41 can be added or removed to replace individual bars 26. Alternately, a single bar retainer 41 for the entire width of bar holder 33 or 37 could be utilized.

A stop member 45 is secured to the lower side of each bar retainer 41 on lower holder 35. Stop member 45 has the same width as each bar retainer 41 and is used to prevent bars 26 from sliding downward relative to lower holder 35. Stop member 45 has a forward portion 45*a* that is offset at a lower elevation from the rearward portion 45*b*. The lower ends of bars 26 abut forward portion 45*a*.

To install bars 26, each bar 26 is placed in holder slots 32 in holders 33, 35 and 37. The upper reduced thickness end 29 of each bar 26 inserts behind the edge of debris plate 16. The lower end of each bar 26 locates below a lower portion of frame 14. Retainers 41 are bolted to holders 33 and 35, with their teeth 43 wedging between each of the bars 26. On the upper end, the contact of debris plate 16 with reduced thickness section 29 prevents forward movement when teeth 43 of the upper retainers 41 are being wedged between bars 26. On the lower end, the lower edge of each bar 26 fits under a portion of frame 14 to prevent forward movement of bar 26 when teeth 43 of the lower retainers 41 are being wedged between bars 26. Stop members 45 are secured to lower holder 35 at the same time that the bar retainers 41 for lower holder 35 are installed.

In operation, screen system 10 is installed in a channel 12. Bar screenfield 18 blocks the passage of solid material or debris in the fluid, while allowing the fluid to pass through.

A motor (not shown) turns both sprockets 31, moving chains 30 and attached rakes 20 upward along the bar screenfield 18. As each rake 20 travels along the bar screenfield 18, rake fingers 28 carry solid material and debris toward the top of the screen system 10 for disposal. When a rake 20 reaches the upper sprockets 31, chains 30 carry it over the upper sprockets 31 and down toward the bottom of screen frame 14 to begin another cleaning cycle as fingers 28 reengage bars 26.

Debris and solids can sometimes damage bars 26 as a result of filtering a fluid channel. When this occurs, the damaged bar 26 is removed by detaching the screenfield bar retainer 41 that secures the damaged bar 26 and then sliding the bar 26 out of the bar screenfield 18. A new bar 26 can be inserted and the screenfield bar retainer 41 re-attached.

Figure 7:
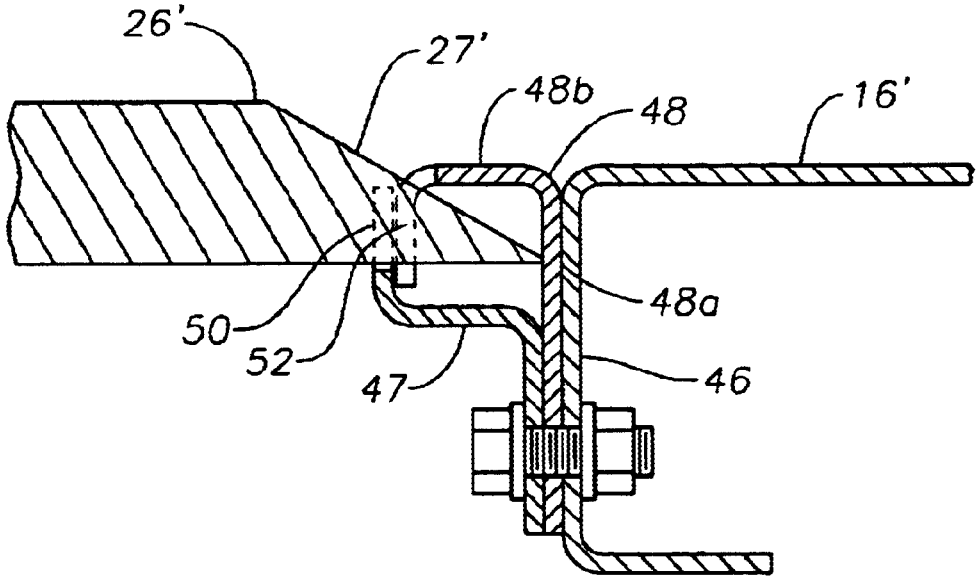
FIG. 7 is a sectional view of an upper screenfield bar holder with a bar installed in accordance with a first alternate embodiment of the present invention.
Figure 8:
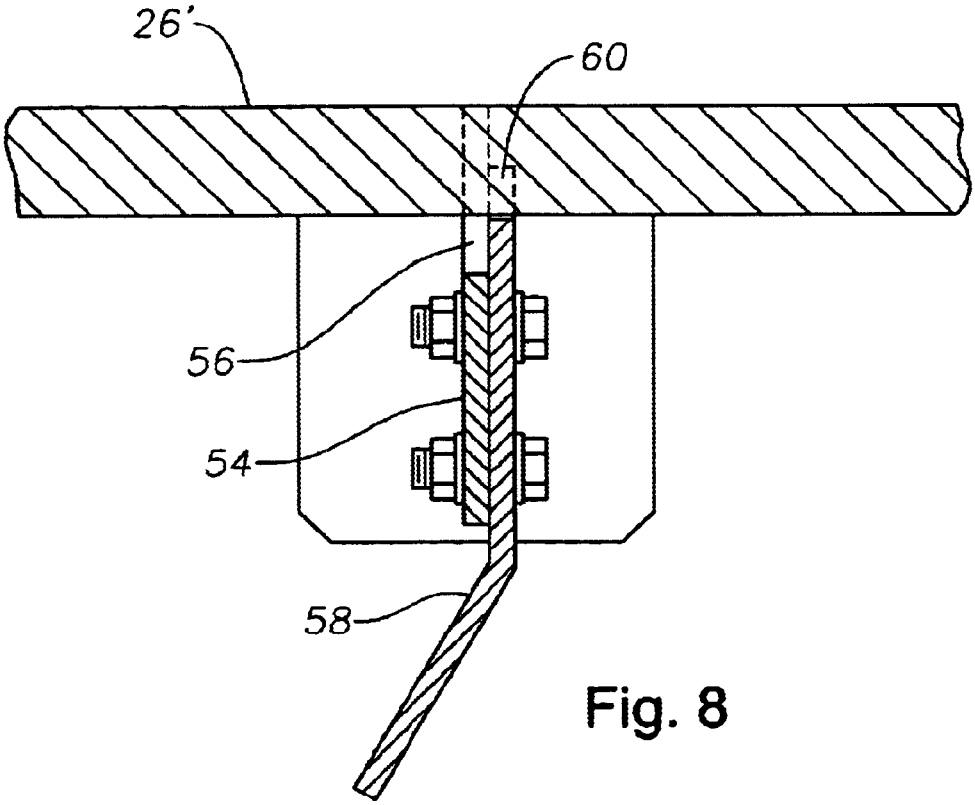
FIG. 8 is a sectional view of an intermediate screenfield bar holder in accordance with the first alternate embodiment of the present invention.
Figure 9:
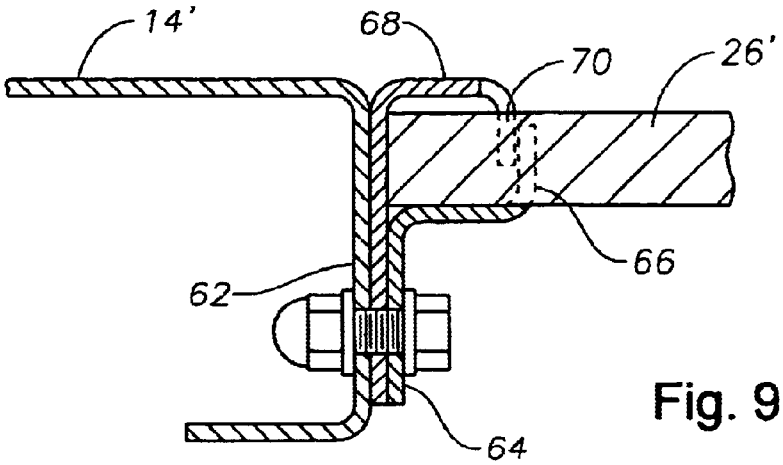
FIG. 9 is a sectional view of a lower screenfield bar holder in accordance with the first alternate embodiment of the present invention.

In addition to the first embodiment, other devices can be used to secure bars 26 individually in place. Two alternate embodiments are shown, with FIGS. 7, 8, and 9 illustrating the first alternate embodiment. FIG. 7 illustrates the support means for the upper edge of screenfield 18. Debris plate 16' has a depending support wall 46 on its lower edge. A bar retainer 47 is secured to wall 46. Bar retainer 47 has an offset forward portion that contains teeth 50 for receiving bars 26'. Teeth 50 extend in a forward direction and are preferably wedge-shaped. A J-shaped holder 48 has a leg portion 48*a* that abuts and is also secured to wall 46. Leg portion 48*a* joins a central portion 48*b* that extends downward from leg portion 48*a*. Teeth 52 depend in a rearward direction from central portion 48*b*, opposite to the direction of teeth 50. Teeth 52 and teeth 50 are in parallel planes and abut and overlap each other. This overlapping engagement defines a closed perimeter aperture for receiving the tapered end 27' of bar 26. A bolt is used to secured retainer 47 and holder 48 to wall 46. Teeth 50 wedge between tapered ends 27' of bars 26'. The closed perimeter aperture defined by the overlapping gaps between teeth 52 and 50 prevent forward and rearward movement of bars 26.

FIG. 8 illustrates the central portions of bars 26' located within slots 56 of an intermediate screenfield bar holder 54. A retainer 58 may optionally be used to wedge the central portions of bars 26' tightly within slots 56. Retainer 58 is a plate that has wedge shaped teeth 60 on its forward end for wedging bars 26' between them. Retainer 58 is secured to holder 54 by bolts.

FIG. 9 illustrates the lower screenfield bar holder support means, which is constructed the same as the upper bar holder support means. Frame 14' has a depending wall 62 that supports a retainer 64 with forward facing wedge-shaped teeth 66. A holder 68 with rearward facing teeth 70 is also supported by wall 62. Teeth 66, 70 engage each other in separate planes to define closed perimeter apertures for receiving ends of bars 26'.

Figure 10:
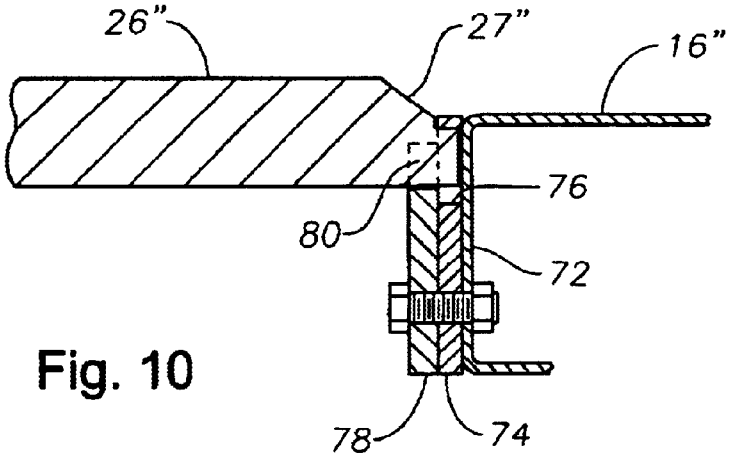
FIG. 10 is a sectional view of an upper screenfield bar holder with a bar installed in accordance with a second alternate embodiment of the present invention.
Figure 11:
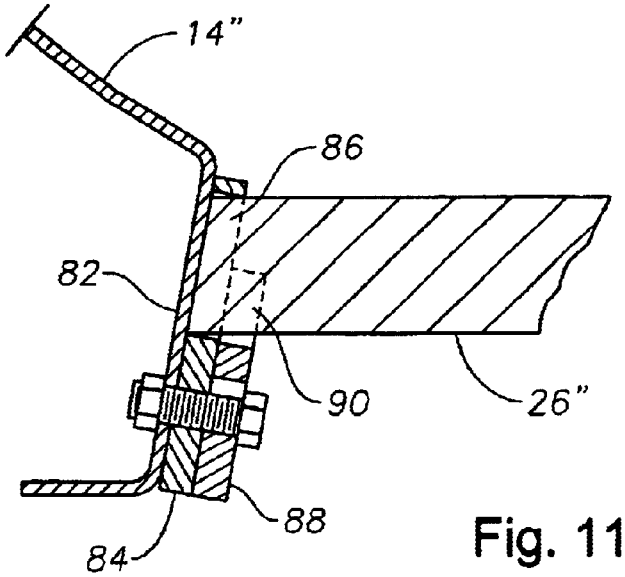
FIG. 11 is a sectional view of a lower screenfield bar holder in accordance with the second alternate embodiment of the present invention.

FIGS. 10 and 11 illustrate a second alternate embodiment. FIG. 10 illustrates the upper screenfield bar holder support means. As in FIG. 7, debris plate 16" has a depending rearward extending wall 72. A bar holder 74 is mounted to wall 72 by bolts. Bar holder 74 has a plurality of slots or apertures 76 on its forward portion, each for receiving the tapered end 27" of the bars 26". Each aperture 76 has a closed perimeter to limit the forward and rearward movement of bar end 27". A retainer 78 is mounted to holder 74, retainer 78 having a plurality of wedge-shaped teeth 80 that face in a forward direction. Teeth 80 wedge bars 26" between them. Apertures 76 prevent forward movement of bars 26" while teeth 80 are being wedged between the bars.

FIG. 11 illustrates the lower screenfield bar holder support means. Frame 14" has a rearward depending wall 82 that supports a bar holder 84. Holder 84 has a plurality of apertures 86, each having a closed perimeter for receiving one of the lower ends of one of the bars 26". A retainer 88 is mounted to holder 84 and wall 82 by bolts. Retainer 88 has forward extending wedge-shaped teeth 90 that wedge bars 26" between them. As in the other embodiments, a plurality of side-by-side retainers 78, 88 could be used for holders 74, 84, or the retainers 78, 88 could extend the full width of each holder 74, 84.

The present invention has many advantages when compared to prior art systems. The first advantage is that the bars do not have to be welded when they are installed. This decreases the costs of manufacturing the screen systems since the labor involved is typically less extensive and less expensive. The second advantage is if one bar breaks, it can easily be replaced without having to cut out and weld a new bar in its place. Since the bars are not welded, this provides an additional advantage in that it avoids warping the bars, which can occur as a result of welding the bars. Additional advantages exist, such as installing and replacing the bars is safer and much faster since welding is not involved. The screen system can be returned to service much faster than with previous repair methods.

While the invention has been shown or described in only some of its forms, it should be apparent to those skilled in the art that it is not so limited, but is susceptible to various changes without departing from the scope of the invention.

What is claimed is:

1. A screen system for removing debris from a flow channel, the system comprising:

a screen frame;

a plurality of bars;

an upper holder and a lower holder carried by the frame for holding the bars on the frame parallel to and spaced apart from each other, the bars being in releasable engagement with the upper and lower holders;

at least one upper retainer and at least one lower retainer that releasably secure to the upper and lower holders, respectively, and wedge upper and lower ends of each of the bars against lateral movement; and a rake having a plurality of tines that fit between bars of the bar screenfield, the rakes being movable along the bars to clear the bar screenfield of debris.

2. The screen system of claim 1, wherein said at least one upper retainer comprises a plurality of the upper retainers mounted releasably to the upper holder, and said at least one lower retainer comprises a plurality of the lower retainers mounted releasably to the lower holder.

3. The screen system of claim 1, wherein the upper holder has a plurality of slots, each of the slots receiving an upper end of one of the bars; and the lower holder has a plurality of slots, each of the slots of the lower holder receiving a lower end of one of the bars.

4. The screen system of claim 3, further comprising an intermediate holder located between the upper and lower holders, the intermediate holder having a plurality of slots, each of the slots of the intermediate holder receiving an intermediate portion of one of the bars.

5. The screen system of claim 1, wherein each bar has a tapered edge on one end that extends from a forward side of the bar toward a rearward side of the bar, the tapered edge being engaged by one of the holders.

6. A screen system for removing debris from a flow channel, the system comprising:

a screen frame;

a plurality of bars;

a plurality of supports for holding the bars on the frame parallel to and spaced apart from each other, the bars being releasably secured to the supports; and a rake having a plurality of tines that fit between bars of the bar screenfield, the rakes being movable along the bars to clear the bar screenfield of debris; wherein at least one of the supports comprises:

a holder having a plurality of slots, each of the slots receiving one of the ends of each of the bars;

a retainer having a plurality of teeth that are wedged shaped, the bars being wedged between the teeth; and a fastener that secures the retainer to the holder.

7. A screen system for removing debris from a flow channel, the system comprising:

a screen frame;

a plurality of bars;

a plurality of supports for holding the bars on the frame parallel to and spaced apart from each other, the bars being releasably secured to the supports; and a rake having a plurality of tines that fit between bars of the bar screenfield, the rakes being movable along the bars to clear the bar screenfield of debris; wherein the supports comprise:

an upper holder having a plurality of slots, each of the slots receiving an upper end of one of the bars;

at least one upper retainer having a plurality of wedge-shaped teeth, the bars having upper ends wedged between the teeth;

a plurality of releasable fasteners securing the upper retainer to the upper holder;

a lower holder having a plurality of slots, each of the slots of the lower holder receiving a lower end of one of the bars;

at least one lower retainer having a plurality of wedge-shaped teeth, the bars having lower ends that are wedged between the teeth of the lower retainer; and a plurality of releasable fasteners securing the lower retainer to the lower holder.

8. A screen system for removing debris from a flow channel, the system comprising:

a screen frame;

a plurality of bars;

a plurality of supports for holding the bars on the frame parallel to and spaced apart from each other, the bars being releasably secured to the supports; and a rake having a plurality of tines that fit between bars of the bar screenfield, the rakes being movable along the bars to clear the bar screenfield of debris; wherein at least one of the supports comprises:

a holder secured to the frame and having a forward portion containing a plurality of slots, each of the slots receiving one of the ends of each of the bars, the forward portion being in a plane substantially perpendicular to a plane containing the bars, the holder having a central portion and a rearward portion, the rearward portion being inclined relative to the central portion;

a retainer having a forward portion containing a plurality of teeth that are wedged shaped, the bars being wedged between the teeth, the retainer having a central portion that is parallel to and abuts the central portion of the holder and a rearward portion that is parallel to and abuts the rearward portion of the holder; and a releasable fastener extending between the central portions of the holder and the retainer for securing the retainer to the holder, the inclination of the rearward portions forcing the teeth forward into wedging engagement with the bars.

9. A screen system for removing debris from a flow channel, the system comprising:

a screen frame;

a plurality of bars;

a plurality of supports for holding the bars on the frame parallel to and spaced apart from each other, the bars being releasably secured to the supports; and a rake having a plurality of tines that fit between bars of the bar screenfield, the rakes being movable along the bars to clear the bar screenfield of debris; wherein at least one of the supports comprises:

a first member mounted to the frame having a plurality of forward extending slots; and a second member having a plurality of rearward extending slots, the slots of the first and second members being located in parallel planes, the slots of the first and second members overlapping one another to define closed perimeter apertures for receiving the bars between them.

10. A screen system for removing debris from a flow channel, the system comprising:

a screen frame;

a plurality of bars;

a plurality of supports for holding the bars on the frame parallel to and spaced apart from each other, the bars being releasably secured to the supports; and a rake having a plurality of tines that fit between bars of the bar screenfield, the rakes being movable along the bars to clear the bar screenfield of debris; wherein at least one of the supports comprises:

a holder secured to the frame, the holder having a plurality of closed perimeter apertures therein through which the bars extend; and a retainer secured to the holder, the retainer having a plurality of wedge-shaped slots through which the bars extend, the slots wedging the bars against movement.

11. A screen system for removing debris from a flow channel, the system comprising:

a screen frame;

a debris plate;

a plurality of parallel bars extending downward from the debris plate;

a holder mounted to the frame and having a plurality of slots into which the bars locate;

a retainer having a plurality of wedge-shaped teeth;

a fastener that secures the retainer to the holder with the bars being located between the teeth; and a rake having a plurality of tines that fit between bars, the rakes being movable along the bars to clear the bars of debris.

12. The screen system of claim 11, wherein the slots are located on a forward portion of the holder, the teeth are located on a forward portion of the retainer, and the fastener is located rearward of the bars.

13. The screen system of claim 11, wherein the slots are located in a plane that is perpendicular to a plane containing the bars, and the teeth are located in a plane that is inclined relative to the plane containing the bars.

14. The screen system of claim 11, wherein:

the holder has a forward portion containing the slots, a central portion, and a rearward portion, the rearward portion being located at an inclined angle relative to the central portion;

the retainer has a forward portion containing the teeth, a central portion, and a rearward portion that abuts and is located in a plane parallel to the rearward portion of the holder; and the fastener comprises a bolt that joins the central portions to each other, and while tightening, the rearward portions force the teeth of the retainer between the bars.

15. The screen system of claim 11, wherein the slots of the holder extend in a rearward direction and the teeth of the retainer extend in a forward direction, the slots and the teeth being in contact with and overlapping one another to define closed perimeter apertures through which the bars extend.

16. The screen system of claim 11, wherein the slots of the holder comprise closed perimeter apertures.

17. The screen system of claim 11, wherein one of the ends of each of the bars has tapered edge extending from a forward side of the bar toward a rearward side of the bar; an wherein the tapered edge locates within one of the slots of the holder and between two of the teeth of the retainer.

18. A method of filtering a fluid channel comprising:

(a) providing a screen system with a screen frame having an upper holder and a lower holder, and a plurality of bars having upper and lower ends and mounted parallel to each other on the upper and lower holders, the upper and lower ends of each bar being retained against lateral movement by upper and lower retainers that releasably mount to the upper and lower holders, respectively, and wedge the upper and lower ends to the upper and lower holders, respectively;

(b) flowing fluid through the channel and through spaces between the bars;

(c) moving a rake along the bars to remove debris that collets thereon; then (d) if damage to one of the bars occurs, releasing the damaged bar from the upper and lower holders by releasing the upper and lower retainers that wedge the damaged bar, and removing and replacing the damaged bar while leaving the other bars in place.

19. A method of filtering a fluid channel comprising:

(a) providing a screen system with a screen frame and a plurality of bars mounted parallel to each other on supports;

(b) flowing fluid through the channel and through spaces between the bars;

(c) moving a rake along the bars to remove debris that collets thereon; then (d) if damage to one of the bars occurs, releasing the damaged bar from the supports and removing and replacing the damaged bar while leaving the other bars in place; wherein step (a) comprises placing the bars within slots provided in the supports, then wedging the bars tightly between teeth of a retainer and securing the retainer to one of the supports.

* * * * *